US006250696B1

(12) United States Patent
Baker

(10) Patent No.: US 6,250,696 B1
(45) Date of Patent: Jun. 26, 2001

(54) CLOTHES STICK APPARATUS

(76) Inventor: Rhonda M. Baker, 1175 Baker St., D-13, Costa Mesa, CA (US) 92626

( * ) Notice: Subject to any disclaimer, the term of this patent is extended or adjusted under 35 U.S.C. 154(b) by 0 days.

(21) Appl. No.: 09/565,801

(22) Filed: May 5, 2000

(51) Int. Cl.[7] ..... D06F 5/00
(52) U.S. Cl. ..... 294/23.5; 248/205.2; 248/206.5
(58) Field of Search ..... 294/7, 8.5, 9–15, 294/19.1, 19.2, 22, 23.5, 24, 26, 55.5, 65.5, 61, 99.1; 24/10 R, 303; 211/DIG. 1; 248/205.2, 206.5

(56) References Cited

U.S. PATENT DOCUMENTS

| | | | | |
|---|---|---|---|---|
| 728,938 | | 5/1903 | Krabach . | |
| 927,546 | | 7/1909 | Johnston . | |
| 990,908 | | 5/1911 | Sangers . | |
| 1,193,950 | * | 8/1916 | Vezina | 294/14 |
| 1,228,945 | * | 6/1917 | Miskimen | 294/23.5 |
| 1,571,220 | * | 2/1926 | Wickersham | 294/23.5 |
| 2,011,896 | | 8/1935 | Grace . | |
| 2,576,242 | | 11/1951 | Stageberg . | |
| 2,594,955 | * | 4/1952 | Markowitz | 248/206.5 |
| 2,798,241 | * | 7/1957 | Cohen | 248/206.5 X |
| 3,370,818 | * | 2/1968 | Perr | 248/205.2 |
| 5,116,093 | * | 5/1992 | Burns | 294/23.5 X |

* cited by examiner

*Primary Examiner*—Johnny D. Cherry

(57) ABSTRACT

A clothes stick apparatus includes a handle which includes a hand-grasping portion and a handle shaft portion which extends longitudinally from the hand-grasping portion. A set of prongs are connected to the handle shaft portion, and one or more magnets are connected to the handle. The hand-grasping portion extends transversely with respect to the handle shaft portion. The handle shaft portion includes a substantially flat bottom surface which lies in a bottom plane. The set of prongs includes a first prong which includes a substantially flat bottom surface which lies in the bottom plane. The first prong is oriented longitudinally with respect to the handle shaft portion. The set of prongs includes a pair of second prongs which include respective substantially flat bottom surfaces which lie in the bottom plane. The second prongs extend at respective acute angles with respect to the first prong. The set of prongs also includes a third prong which extends upward from the handle shaft portion outside the bottom plane. With one embodiment of the invention, a plurality of discrete magnets are arrayed along the handle shaft portion. With another embodiment of the invention, a magnetic strip or a strip of hook-or-loop fastener material is attached to the bottom surface of the handle shaft portion.

6 Claims, 3 Drawing Sheets

FIG 1
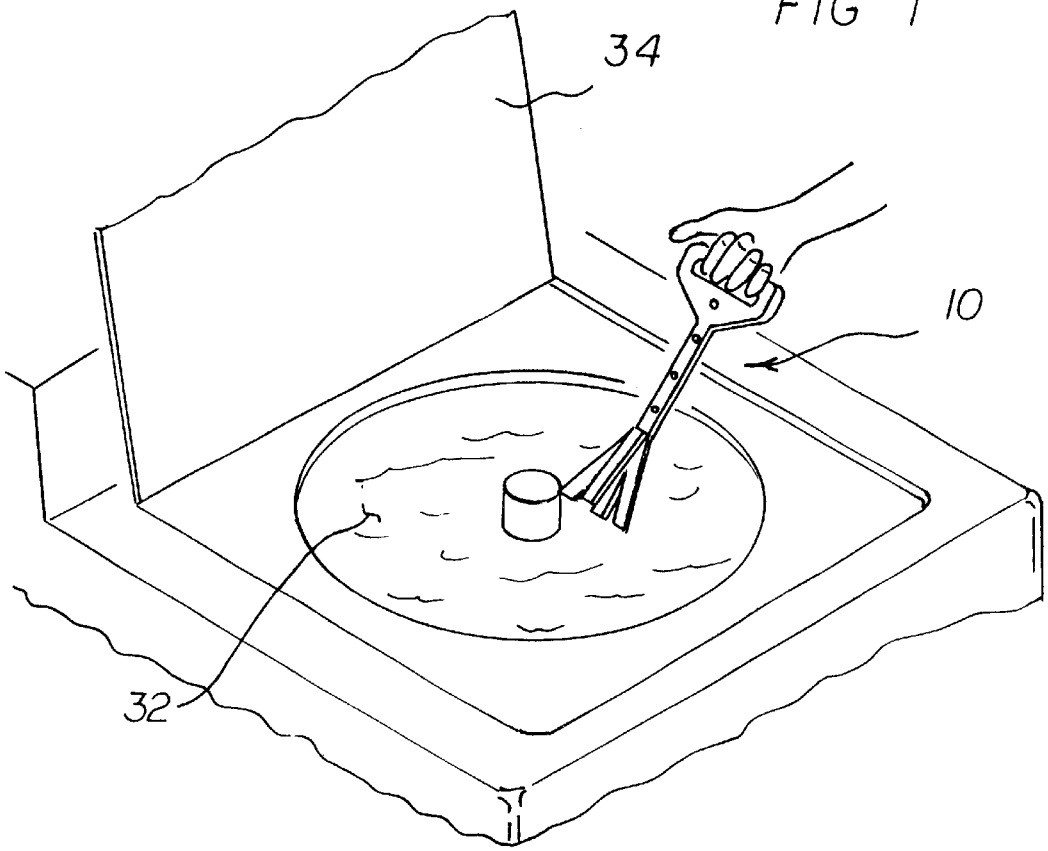
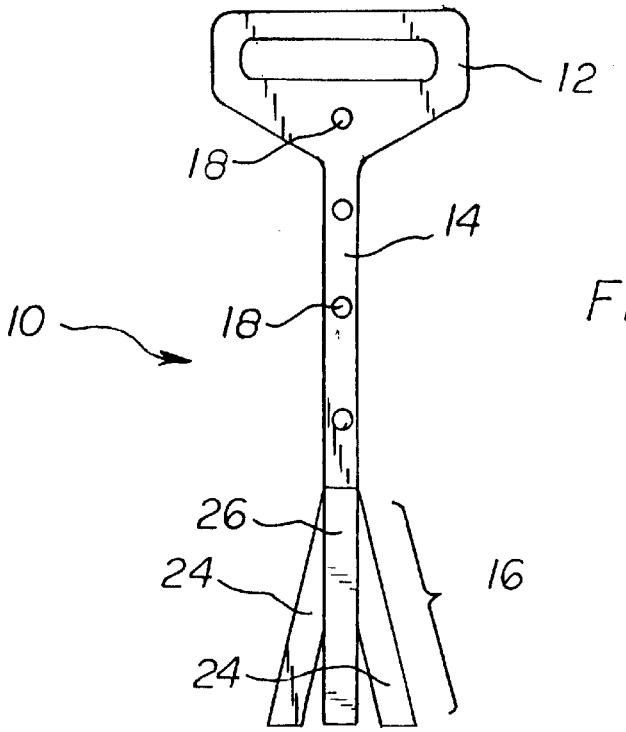
FIG 2

CLOTHES STICK APPARATUS

BACKGROUND OF THE INVENTION

1. Field of the Invention

The present invention relates generally to laundry aids and, more particularly, to clothes sticks especially adapted for manipulating laundry in a laundry tub.

2. Description of the Prior Art

When clothes are in a laundry tub, immersed in water, it is often necessary or desirable to manipulate the wet clothes in the tub. To do so, one would generally immerse one's hand and arm into the tub. However, for a number of reasons, one may wish to avoid immersing one's hand and arm into the water in the tub. The water may be very hot or very cold. The water may be very dirty or very soapy. To avoid the need for immersing one's hand and arm into the water in a laundry tub, a number of innovations have been developed throughout the years relating to hand-held clothes sticks, and the following U.S. patents are representative of some of those innovations: U.S. Pat. Nos. 728,938, 927,546, 990,908, 2,011,896, and 2,576,242. More specifically, U.S. Pat. Nos. 728,938 and 927,546 disclose clothes sticks which have a handle and two prongs. To provide greater ability to twist, untwist, lift, and move clothes in a laundry tub, it would be desirable if a clothes stick were provided which included three or more prongs.

U.S. Pat. No. 990,908 discloses a clothes stick in which the handle is received inside a triangular reception region defined by three prongs. As a result, when the clothes stick is placed against a flat surface, the handle portion of the clothes stick cannot lie flat against the flat surface. For a reason stated below, it would be desirable if a clothes stick were provided in which a three or more pronged clothes stick has a handle that can lie flat against a flat surface.

Each of U.S. Pat. Nos. 2,011,896 and 2,576,242 discloses a clothes stick having three or more prongs. It is noted, however, that with these two patents, as well as with the other three patents discussed above, none of the patents discloses a clothes stick which has means for attaching to a laundry machine when the clothes stick is not in use. More specifically, since a clothes stick is an apparatus which is independent from a laundry machine, it is all to easy to misplace or lose a clothes stick. In this respect, it would be desirable if a clothes stick were provided that has means for attaching to a laundry machine when not in use so that there would be less chance for the clothes stick to be misplaced or lost.

Still other features would be desirable in a clothes stick apparatus. As stated above, it would be desirable if means were provided for attaching a clothes stick to a laundry machine when the clothes stick is not in use. It is noted that most laundry machines are made of iron-containing metal, and, in this respect, most laundry machines can be adhered to by magnets. With this mind, it would be desirable if a clothes stick were provided which included a magnet or other fastener for conveniently attaching the clothes stick to a laundry machine when the clothes stick is not in use.

Another feature of all of the clothes sticks disclosed above is noted. All of these clothes sticks have handles which include hand-grasping portions which extend longitudinally from the respective prongs. To increase comfort in grasping the handle of a clothes stick and to increase control in using the clothes stick to manipulate wet clothes in a laundry machine, it would be desirable if a clothes stick were provided with a hand-grasping portion which extends transversely with respect to a longitudinal handle portion between the hand-grasping portion and the prongs.

Thus, while the foregoing body of prior art indicates it to be well known to use clothes sticks, the prior art described above does not teach or suggest a clothes stick apparatus which has the following combination of desirable features: (1) includes three or more prongs; (2) has a handle that can lie on a flat surface; (3) has means for attaching the clothes stick to a laundry machine or other convenient location when not in use; (4) includes a magnet or other fastener for attaching the clothes stick to a laundry machine when the clothes stick is not in use; and (5) has a hand-grasping portion which extends transversely with respect to a longitudinal handle portion between a hand-grasping portion and the prongs. The foregoing desired characteristics are provided by the unique clothes stick apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a clothes stick apparatus which includes a handle which includes a hand-grasping portion and a handle shaft portion which extends longitudinally from the hand-grasping portion. A set of prongs are connected to the handle shaft portion, and one or more magnets are connected to the handle. The hand-grasping portion extends transversely with respect to the handle shaft portion. The handle shaft portion includes a substantially flat bottom surface which lies in a bottom plane.

The set of prongs includes a first prong which includes a substantially flat bottom surface which lies in the bottom plane. The first prong is oriented longitudinally with respect to the handle shaft portion. The set of prongs includes a pair of second prongs which include respective substantially flat bottom surfaces which lie in the bottom plane. The second prongs extend at respective acute angles with respect to the first prong. The set of prongs also includes a third prong which extends upward from the handle shaft portion outside the bottom plane. With one embodiment of the invention, a plurality of discrete magnets are arrayed along the handle shaft portion. With another embodiment of the invention, a magnetic strip or strip of hook-or-loop fastener material is attached to the bottom surface of the handle shaft portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clothes stick apparatus which has all of the advantages of the prior art and none of the advantages.

It is another object of the present invention to provide a new and improve clothes stick apparatus which may be easily and efficiently manufactured and marketed.

It is a further object of the present invention to provide a new and improved clothes stick apparatus which is of durable and reliable construction.

An even further object of the present invention is to provide a new and improved clothes stick apparatus which is susceptible of a low cost of manufacture with regard to both materials and labor, and which accordingly is then susceptible of low prices of sale to the consuming public, thereby making such clothes stick apparatus available to the buying public.

Still yet a further object of the present invention is to provide a new and improved clothes stick apparatus which includes three or more prongs.

Still another object of the present invention is to provide a new and improved clothes stick apparatus that has a handle that can lie on a flat surface.

Yet another object of the present invention is to provide a new and improved clothes stick apparatus which has means for attaching the clothes stick to a laundry machine when not in use.

Even another object of the present invention is to provide a new and improved clothes stick apparatus that includes a magnet for attaching the clothes stick to a laundry machine when the clothes stick is not in use.

Still a further object of the present invention is to provide a new and improved clothes stick apparatus which has a hand-grasping portion which extends transversely with respect to a longitudinal handle portion between a hand-grasping portion and the prongs.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first embodiment of the clothes stick apparatus of the invention in use with laundry in a laundry tub.

FIG. 2 is a top view of the embodiment of the clothes stick apparatus shown in FIG. 1.

DESCRIPTION OF THE PREFERRED EMBODIMENT

Figure 3:
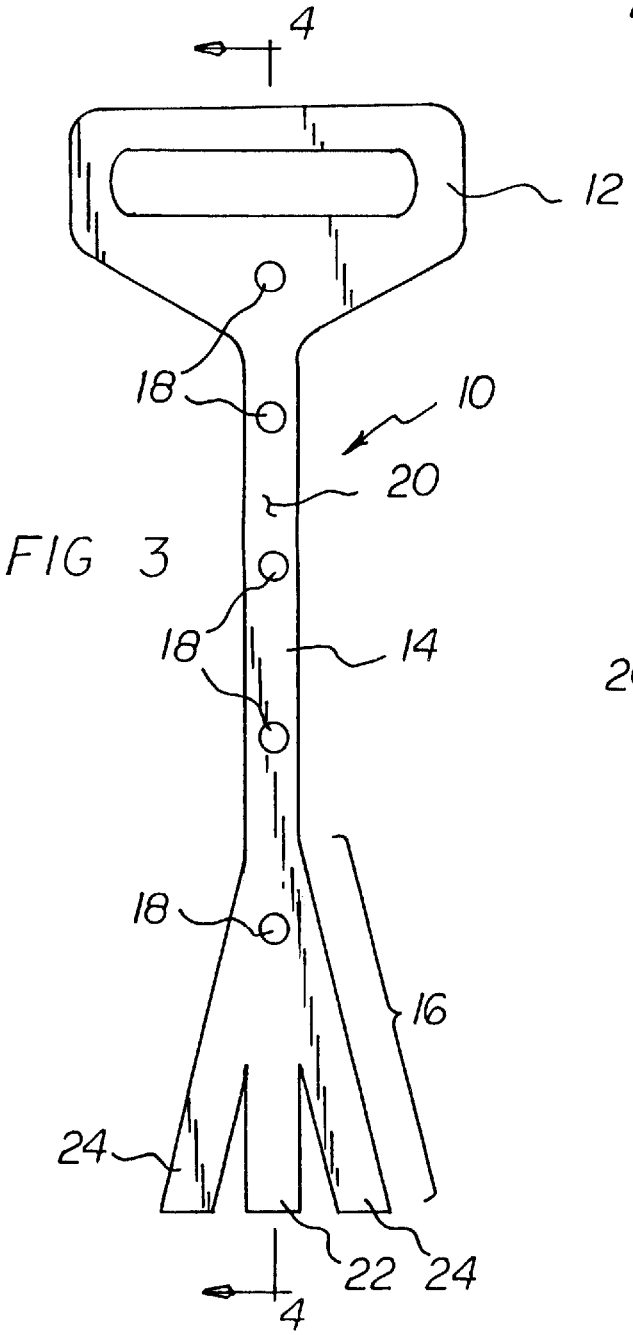
FIG. 3 is a bottom view of the embodiment of the clothes stick apparatus shown in FIG. 1.
Figure 4:
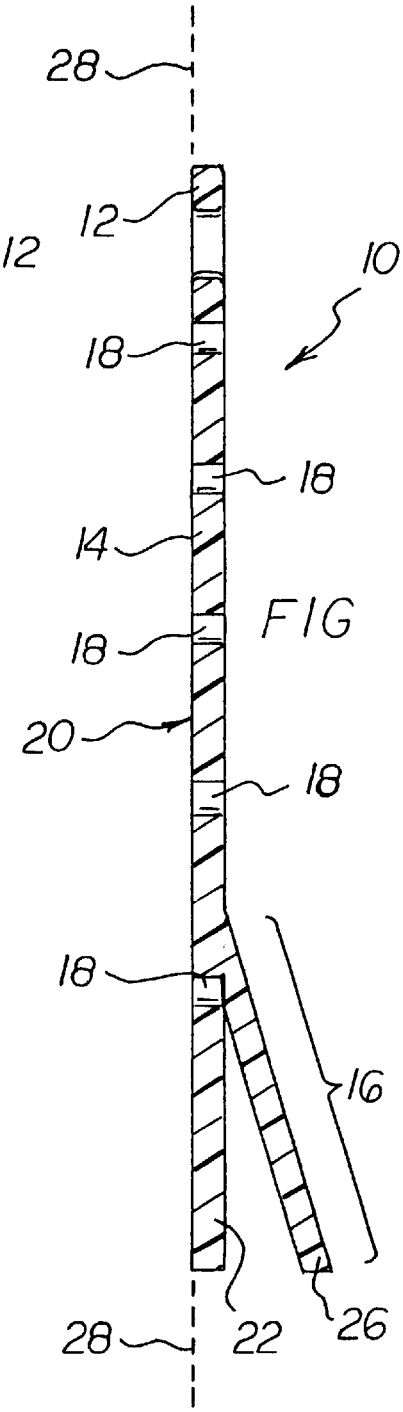
FIG. 4 is a cross-sectional view of the embodiment of the clothes stick apparatus of FIG. 3 taken along line 4—4 thereof.

With reference to the drawings, a new and improved clothes stick apparatus embodying the principles and concepts of the present invention will be described.

Turning to FIGS. 1–5, there is shown a first embodiment of the clothes stick apparatus of the invention generally designated by reference numeral 10. In its preferred form, clothes stick apparatus 10 includes a handle which includes a hand-grasping portion 12 and a handle shaft portion 14 which extends longitudinally from the hand-grasping portion 12. A set of prongs 16 are connected to the handle shaft portion 14, and one or more magnets are connected to the handle. The hand-grasping portion 12 extends transversely with respect to the handle shaft portion 14. The handle shaft portion 14 includes a substantially flat bottom surface 20 which lies in a bottom plane 28.

The set of prongs 16 includes a first prong 22 which includes a substantially flat bottom surface which lies in the bottom plane 28. The first prong 22 is oriented longitudinally with respect to the handle shaft portion 14. The set of prongs 16 includes a pair of second prongs 24 which include respective substantially flat bottom surfaces which lie in the bottom plane 28. The second prongs 24 extend at respective acute angles with respect to the first prong 22. The set of prongs 16 includes a third prong 26 which extends upward from the handle shaft portion 14 outside the bottom plane 28.

With one embodiment of the invention, a plurality of discrete magnets 18 are arrayed along the handle shaft portion 14. The magnets may extend completely through the transverse extent of the handle shaft portion 14 substantially as shown, or be embedded in the bottom surface of handle shaft portion 14. In either case, it is preferred that the outwardly facing surface of each magnet be substantially flush with the surface of the bottom of handle shaft portion 14, i.e. the surface of each magnet should preferably be co-planar with respect to bottom plane 28.

To use the clothes stick apparatus 10 of the invention, as shown in FIG. 1, a person grasps the hand-grasping portion 12 of the handle. The set of prongs 16 are lowered into the laundry tub 32. The user of the clothes stick apparatus 10 does not need to immerse one's hand or arm into the water in the laundry tub 32 to move the laundry around in the tub, to add laundry to the tub, or to remove laundry from the tub.

Figure 5:
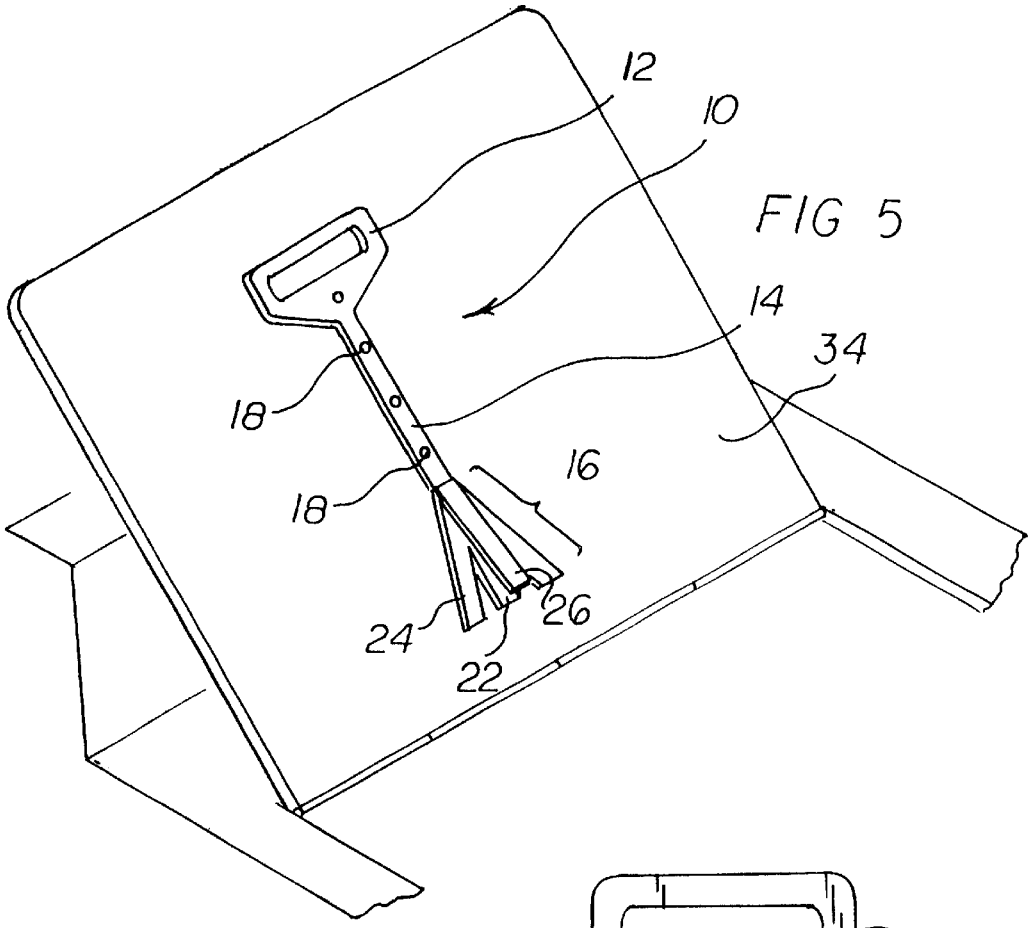
FIG. 5 is a perspective view of the embodiment of the invention shown in FIGS. 1–4 attached to a lid of laundry machine.

Once it is no longer needed to use the clothes stick apparatus 10, the clothes stick apparatus 10 can be attached to the lid 34 of the laundry machine as shown in FIG. 5. More specifically, the bottom surface 20 of the clothes stick apparatus 10 is placed in contact with the surface of the lid 34 so that the magnets 18 exert their attracting effects on the lid 34. In this way, the clothes stick apparatus 10 is attached to the lid 34 of the laundry machine. If desired, the clothes stick apparatus 10 can be attached by magnetic attraction to any other iron-containing flat surface of the laundry machine.

Figure 6:
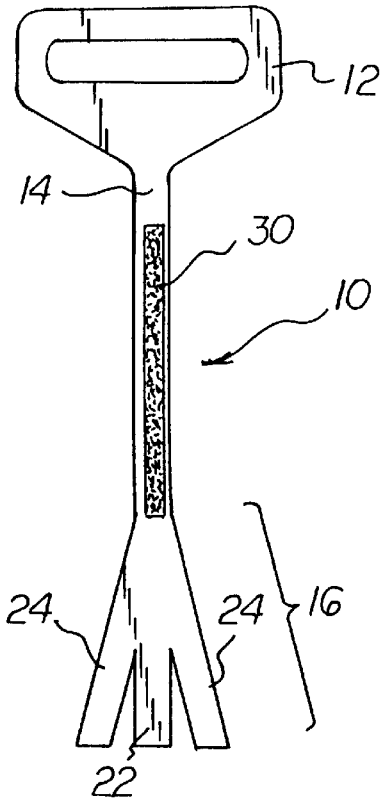
FIG. 6 is a bottom view of a second embodiment of the invention in which a magnetic strip is provided.

Turning to FIG. 6, a second embodiment of the invention is shown. Reference numerals are shown that correspond to like reference numerals that designate like elements shown in the other figures. With the second embodiment of the invention, magnet means are in the form of a magnetic strip 30 which is attached to the bottom surface 20 of the handle shaft portion 14. Alternatively, magnet strip 30 may comprise a strip of hook-or-loop fastening material such as is widely available under the trademark VELCRO. In such event a complimentary strip of hook-or-loop fastening material should be adhered to the underside of lid 34, or some other convenient location, as will occur to those of ordinary skill.

The clothes stick apparatus of the invention can be made from inexpensive and durable non-magnetic metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved clothes stick apparatus that is low in cost, relatively simple in design and operation, and which advantageously has three or more prongs. With the invention, a clothes stick apparatus is provided which has a handle that can lie on a flat surface. With the invention, a clothes stick apparatus is provided which has means for attaching the clothes stick to a laundry machine when not in use. With the invention, a clothes stick apparatus is provided which includes a magnet for attaching the clothes stick to a laundry machine when the clothes stick is not in use. With the invention, a clothes stick apparatus is provided which has a hand-grasping portion which extends transversely with respect to a longitudinal handle portion between a hand-grasping portion and the prongs.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A clothes stick apparatus, comprising:

a handle which includes a hand-grasping portion and a shaft portion which longitudinally extends from said hand-grasping portion, a set of prongs connected to said handle shaft portion, said handle and said set of prongs having a substantially constant thickness dimension defining a substantially flat first surface and a second opposed surface, said substantially flat first surface defining an imaginary plane common to said hand-grasping portion, said shaft portion extending longitudinally from said hand-grasping portion, and said set of prongs connected to said handle shaft portion, wherein said set of prongs includes a first prong extending longitudinally and distally from said handle shaft portion, and a pair of second prongs extending at respective first acute angles from said shaft portion with respect to said first prong, said pair of second prongs being juxtaposed with respect to said first prong on opposite sides thereof, respectively, whereby said set of prongs defines first, second and third prongs longitudinally and distally extending from said handle shaft portion, said apparatus further including a fourth prong extending longitudinally and distally from said handle shaft portion, said fourth prong having a surface portion that extends at an acute angle with respect to said first prong second opposed surface, said fourth prong surface portion being aligned with said first prong such that an imaginary longitudinal axis passing through said fourth prong surface portion intercepts said imaginary common plane defining said first surface at said second acute angle, and fastening means located on said first surface for removably attaching said first surface to a substantially flat other surface along said common plane.

2. The apparatus of claim 1 wherein said hand-grasping portion extends transversely with respect to said handle shaft portion.

3. The apparatus of claim 1 wherein said fastening means include magnet means.

4. The apparatus of claim 3 wherein said magnet means includes a magnetic strip attached to said first surface of said handle shaft portion.

5. The apparatus of claim 3 wherein said fastening means includes a hook-or-loop fastener strip attached to said first surface of said handle shaft portion.

6. The apparatus of claim 1 wherein said magnet means includes a plurality of discrete magnets arrayed along said handle shaft portion.

* * * * *